United States Patent [19]

DeBlois

[11] Patent Number: 4,541,403

[45] Date of Patent: Sep. 17, 1985

[54] BOW-MOUNTED QUIVER OF THE MAGAZINE TYPE

[76] Inventor: Charles DeBlois, 86 Armour Ave., Trenton, N.J. 08619

[21] Appl. No.: 485,361

[22] Filed: Apr. 15, 1983

[51] Int. Cl.[4] ..... F41B 5/06

[52] U.S. Cl. ..... 124/51 R

[58] Field of Search ..... 124/23 R, 24 R, 41 A, 124/48, 45, 86, 88

[56] References Cited

U.S. PATENT DOCUMENTS

| | | |
|---|---|---|
| 3,017,874 | 1/1962 | Gubash . |
| 3,116,730 | 1/1964 | Tingley . |
| 3,595,215 | 7/1971 | Wilkie . |
| 3,601,113 | 8/1971 | Wilkie . |
| 3,716,174 | 2/1973 | Ehlert . |
| 4,247,027 | 1/1981 | Tardiff . |

*Primary Examiner*—Richard J. Apley
*Assistant Examiner*—William R. Browne
*Attorney, Agent, or Firm*—Sperry, Zoda & Kane

[57] ABSTRACT

A quiver is attachable to a conventional bow to position a series of arrows in rapidly following succession for discharge by the bowman. Disclosed is an attachment which can be bodily adjusted to operative and inoperative positions upon the bow, and when operatively positioned, will position an arrow directly upon the bowstring, as a response to discharge of another, preceding arrow. Discharge of an arrow causes the bowstring to shift an operating plunger in a direction to momentarily disengage a latch device from a spring loaded, rotatable magazine. The magazine, thus freed for rotation, turns through a predetermined angular distance to laterally displace the next arrow to be discharged. The nock of the laterally shifted arrow is caused to be positioned upon the bowstring. At the same time, the latching device returns to a position latching the magazine against further rotation, leaving it in proper position for displacement of yet another arrow to a ready-for-discharge position.

19 Claims, 9 Drawing Figures

BOW-MOUNTED QUIVER OF THE MAGAZINE TYPE

The present invention relates generally to archery, and in a more particular sense, has reference to quivers designed especially for bow-and-arrow hunters.

In recent years, hunting with the bow and arrow has become an increasingly popular sport. Stalking or lying in wait for the elusive deer or other game, until the game animal is within bow-and-arrow range, is difficult and all too frequently the target exists only for a few seconds. Often, the hunter may miss with his first arrow, but may still have time for a second shot. The sound of a rifle shot may instantaneously cause the game animal to run. Conversely, when an arrow is discharged and misses the target, the animal frequently stands for a few moments, perhaps not realizing its danger immediately and perhaps also endeavoring to sense the direction from which the arrow may have come.

Accordingly, it is desirable that equipment be provided that will permit the hunter to nock another arrow and discharge it with an absolute minimum of delay. Manually removing an arrow from a quiver does not permit this, of course, and accordingly, it has been heretofore proposed to provide magazine-type quivers, that will deliver arrows in rapidly following succession for nocking and discharge. As a result, the hunter has an opportunity for a second and perhaps a third shot at the game before it takes cover.

Magazine-type quivers that have heretofore been devised, however, have had certain deficiencies, and it is proposed as a broad object of the present invention to eliminate these deficiencies to the maximum extent possible.

For example, magazine-type quivers that have heretofore been devised have in many instances been so designed as to fail to deliver arrows quickly enough to satisfy the demands of the situation. In some instances, this results from the positioning of the arrows in the quiver relative to the bowstring, that is, the arrows are displaced a substantial distance from the bowstring while in the magazine, and have had to be moved a substantial distance and re-oriented prior to nocking.

In other prior art devices of this type, it has been necessary for the bowman to manually actuate a triggering means for the purpose of drawing an arrow from the quiver to a nocking position. This too is time-consuming, and takes the bowman's hands away from the proper position in which they should be for nocking an arrow, drawing the bowstring, sighting the target, and releasing the arrow.

It is an important object of the present invention, in view of the above and other deficiencies noted in the prior art devices of this same general type, to provide a quiver of the magazine-type so designed that arrows will be delivered to nocking position in rapidly following succession, in less time than has heretofore been required, so as to permit the hunter to discharge a maximum number of arrows before the game animal takes cover.

Another object is to provide a device of the character described in which the hunter is required to do no more than hold the bow, sight the target, and discharge arrows with a complete economy of motion, that is to say, it is an object to provide a device in which the hunter holds the bow and discharges arrows without moving his hands or body from the positions that they would normally assume in sighting a target and discharging an arrow toward the target.

Another object is to provide a device of the type stated which will not require any modification whatever of conventional bows, or the arrows used therewith.

Still another object is to provide a magazine-type quiver characterized by its general safety and reliability of operation.

Summarized briefly, the invention devised for the purpose of carrying out the above-stated objects comprises an attachment to a conventional hunting bow. Included in the invention is a tubular, open-ended housing, which is so mounted upon the bow as to permit its being swiftly and easily adjusted between operative and inoperative positions.

Within the housing, there is provided a rotatably mounted magazine, which is under spring loading tending to rotate the same in a predetermined direction, when arrows are to be delivered by the magazine to a nocking position.

The magazine is so formed as to hold a plurality of arrows, for example four arrows, with the arrows being supported on spring-loaded arms. A latching device is also attached to the bow, and normally prevents rotation of the magazine. As part of the invention, there is provided a latch-releasing plunger, which is so located as to be actuated by the string of the bow, as a consequence of the normal movement of the bowstring on discharge of an arrow.

The resultant, momentary unlatching of the magazine causes the rotation thereof through an angular distance sufficient to displace, laterally, the next arrow, directly into a position in which the nock thereof engages the bowstring. The hands of the hunter at all times remain, respectively, in position to grip the bow and draw the bowstring, so that as each arrow is discharged, another arrow is immediately ejected from the magazine to the nock position, ready to follow the immediately preceding arrow toward the target.

While the invention is particularly pointed out and distinctly claimed in the concluding portions herein, a preferred embodiment is set forth in the following detailed description which may be best understood when read in connection with the accompanying drawings, in which:

Figure 1:
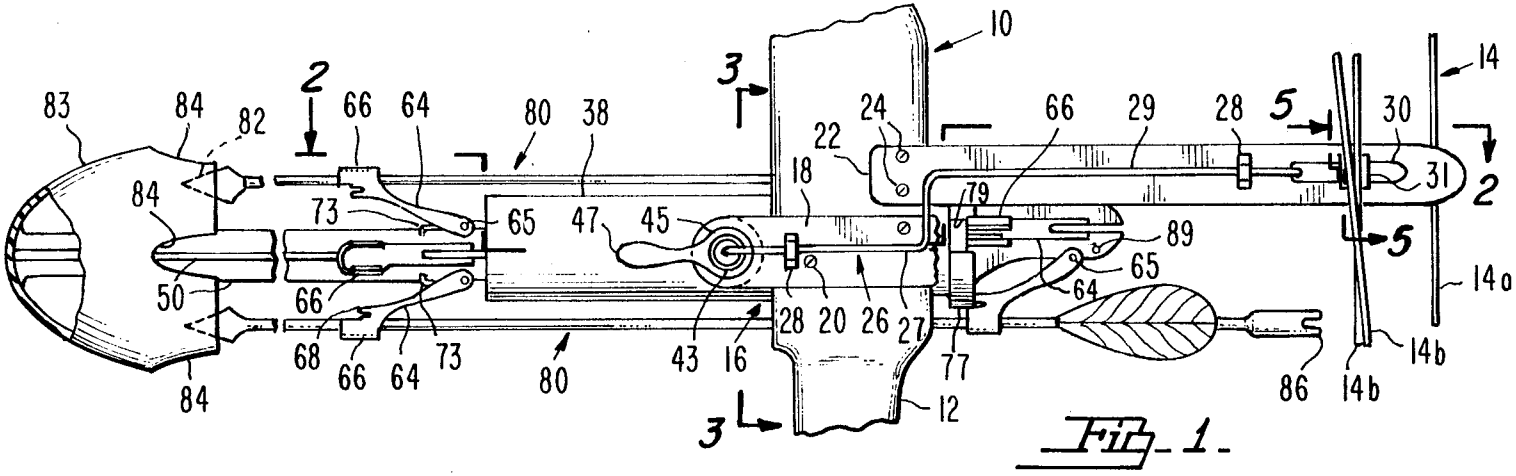
FIG. 1 is a side elevational view of a magazine-type quiver formed according to the present invention, as it appears when in operative position, portions being broken away and other portions being shown in section, a bow to which the quiver is attached being shown fragmentarily, in side elevation.

Referring to the drawing in detail, the reference numeral 10 generally designates a conventional bow, having the usual hand grip 12 and bowstring 14. The magazine-type quiver comprising the invention has been generally designated at 16. It includes a flat, generally rectangular, horizontally elongated base plate 18 fixedly secured as by screws 20 to one side of the bow above and in closely spaced relation to the hand grip 12.

A horizontally elongated, generally flat plunger guide plate 22 disposed above and in closely spaced, generally parallel relation to the plate 18, is coplanar with the base plate, and is fixedly secured to the bow by screws 24, in position extending rearwardly to the bowstring 14.

Bow 10, it may be noted at this point, is of the conventional type in which the bowstring is pulley-mounted, including a rear section **14*a* received in the nock of the arrow to be discharged, and adapted to be pulled rearwardly to an arrow-releasing position. The bowstring further includes forward sections 14*b***. A conventional hunting bow of this type is illustrated in U.S. Pat. No. 4,247,027 to Tardiff, and so far as the bow is concerned, the disclosure thereof in that patent is incorporated in the present application by reference.

In accordance with the invention, an actuating plunger 26 has relatively offset sections 27, 29 extending longitudinally and centrally of the plates 18, 22 respectively, and mounted for sliding movement on the plates in plunger guides 28 carried by the plates.

Figure 5:
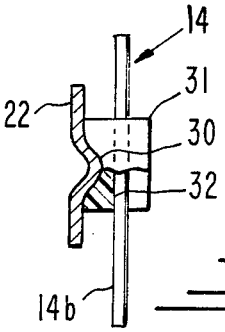
FIG. 5 is an enlarged, detail, transverse sectional view substantially on line 5—5 of FIG. 1, illustrating the bowstring guide.

Pressed out of the rear portion of the plunger support plate 22 is an elongated, longitudinally and centrally extending string guide support rib 30 (FIGS. 1, 2, and 5) receiving a bowstring guide 31 having grooves or guide slots 32, in side-by-side relation to receive the string sections **14*b*. String guide 31 is recessed on its underside to receive rib 30**.

At this point, it may be noted that it is a conventional accessory to hunting bows of the type referred to herein, to provide a plate 22 having rib 30 supporting a string guide 31 formed as illustrated. Heretofore, however, the string guide has been used simply for the purpose of maintaining the sections **14*b* in side-by-side relation, in non-interfering positions with respect to the arrow being discharged and string section 14*a*. It is for this reason that plate 22 has been used, extending as a divider between the sections 14*b* located at one side of the plate, and the section 14*a* located at the other side as shown clearly in FIGS. 1 and 2. String sections 14*b* exert a pressure against the guide 31 tending to hold it seated against rib 30**, though being freely slidable upon the rib.

It is further a characteristic of hunting bows of this type, having a string guide means such as shown at 30, 31, that on discharge of an arrow, the string sections **14*b* move forwardly to a limited extent, shifting guide 31 toward the front end of the guide support rib 30**.

Figure 2:
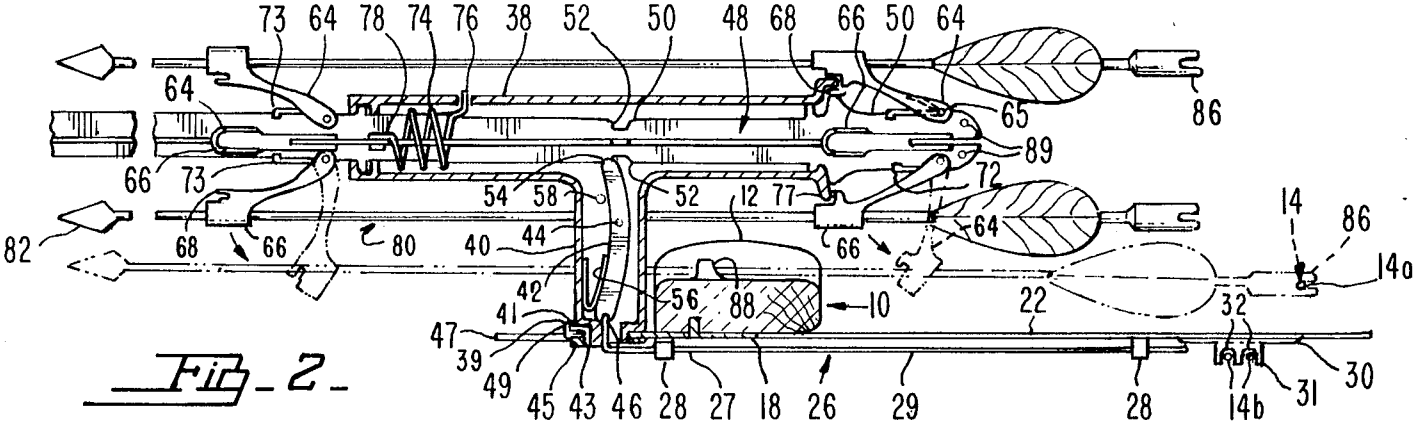
FIG. 2 is a horizontal sectional view substantially on line 2—2 of FIG. 1, the dotted lines indicating the quiver mechanism and an arrow as they appear during displacement of the arrow to its nock position.

In accordance with the invention, as previously noted plate 22 assumes an added function of slidably supporting the plunger 26. The rear end of the plunger normally, as shown in FIGS. 1 and 2, is disposed a short distance forwardly of the guide 31, such that when an arrow is discharged, string sections **14*b* will snap guide 31 forwardly, striking the rear end of the plunger 26** and causing the plunger to be shifted forwardly a slight distance. This, as will appear from the further description of the invention to be provided hereinafter, will actuate the quiver mechanism to displace the next arrow to a shooting position.

Designated at 38 is an elongated, open-ended, cylindrical housing having intermediate its ends (FIGS. 2 and 3) a lateral extension in the form of a flattened tubular member 40 integrally formed with a flared, circular mounting base 41 having a reduced, externally threaded, circular neck 43. An internally threaded ring 45 extends about and is threadedly engaged with the neck, and is integrally formed with an operating handle 47 (FIG. 1).

On the plate 18 there is provided (FIG. 2) a lip 39 engageable with a lug 49 provided upon the base end 41 of the lateral extension 40. By reason of this arrangement, the entire quiver attachment 16 constituting the present invention can be bodily rotated through 90°, between an inoperative position in which it extends generally parallel with the bow, that is, approximately vertically as viewed in the drawings, and an operative position in which it extends horizontally, ready for use as shown in FIGS. 1 and 2. One would adjust the device to the inoperative position, not shown, by backing off ring 45 to an extent sufficient for turning of the base end 41, and hence the entire housing and the magazine and arrows supported thereby, to permit rotation of the quiver attachment 16 to the inoperative position. When the quiver attachment is so located, the handle 47 can be used to turn the locking ring 45 in the opposite direction, so as to clamp the base 41 against the plate 18.

When the bowman determines that it is time to ready the device for use, the locking ring is again loosened, and the device is rotated from the vertical inoperative position through 90° to the horizontal, use position illustrated in the drawing. The exact use position is found by the engagement of the lug 49 against the stop 39. The lock ring is again tightened, and the quiver attachment is now ready for use.

Figure 3:
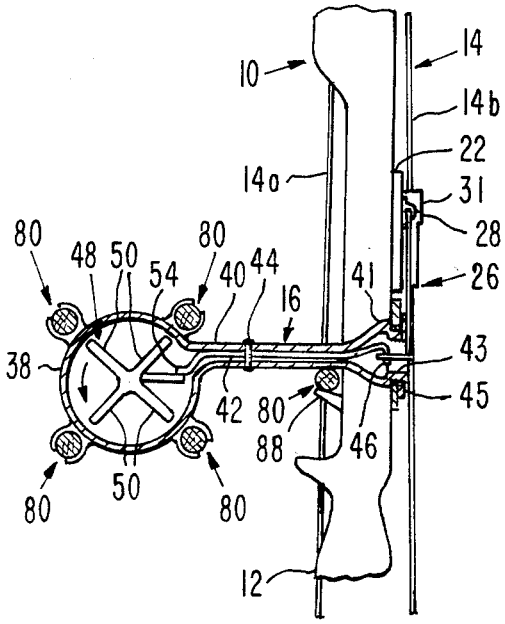
FIG. 3 is a transverse sectional view substantially on line 3—3 of FIG. 1, one of the arrows being shown in its nocked or shooting position.

Referring to FIGS. 2 and 3, a stop arm 42 is mounted for limited swinging movement within extension 40, through the provision of a pivot pin 44. At one end, as shown in FIG. 3, arm 42 has a slot 46, receiving the inturned front end of plunger 26. As a result, when the plunger is shifted forwardly by the bowstring guide 31, it will rotate the arm 42 in a clockwise direction, viewing the same as in FIG. 2, from a normal locking or stop position in which the arm 42 engages a magazine 48 rotatably mounted within the housing.

Figure 9:
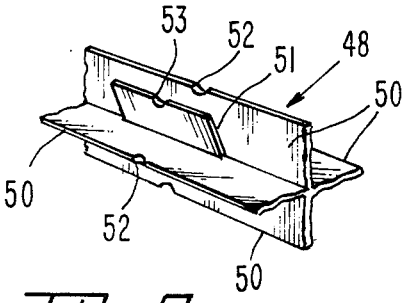
FIG. 9 is a fragmentary perspective view of the magazine, per se.

The magazine is formed to include a plurality of longitudinally extending radial fins 50. Referring to FIG. 3, in the present example four such fins are provided, although this number can be increased or decreased as desired. The arrow-supporting fins 50, in the illustrated example, are spaced 90° apart, and between two of them there is provided a starting fin 51 which as seen from FIG. 9 can be relatively short in length since it has no arrow-supporting function.

The several fins 50 are provided, intermediate their ends, with recesses 52, while starting fin 51 has a corresponding recess 53. Referring to FIG. 2, the distal end 54 of lever 42 is normally positioned, under the bias of a leaf spring 56 engaging arm 42, in a slightly offset position relative to the recesses 52, 53. As a result, the distal end 54 of arm 42 engages each fin, in following order during the use of the device, to prevent rotation of the magazine 48. Preferably, a stop lug 58 is provided within extension 40 to limit the extent to which the distal end 54 may be offset in respect to the recesses 52.

The magazine projects at its front and rear ends from the housing 38, and is provided, on the projecting ends thereof, with arrow support arms 64. The arrow support arms at the rear and at the front of the magazine (FIGS. 1 and 2) are identical, there being one rear arm and one front arm on each of the fins 50. Each arm is mounted on its associated fin by a pivot pin 65, for swinging movement between the normal, retracted, full line position of FIG. 8, to its final rest position shown in dashed lines in FIG. 8, in which it engages against a stop 62 provided on the fin adjacent the pivot pin 65.

Figure 6:
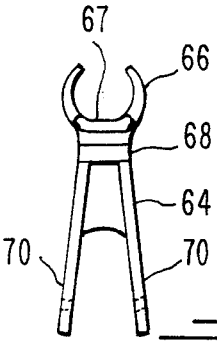
FIG. 6 is an enlarged front elevational view of one of the arrow displacement arms, per se.
Figure 7:
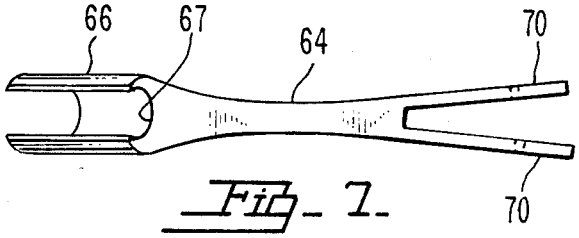
FIG. 7 is a top plan view of the arm shown in FIG. 6, per se.
Figure 8:
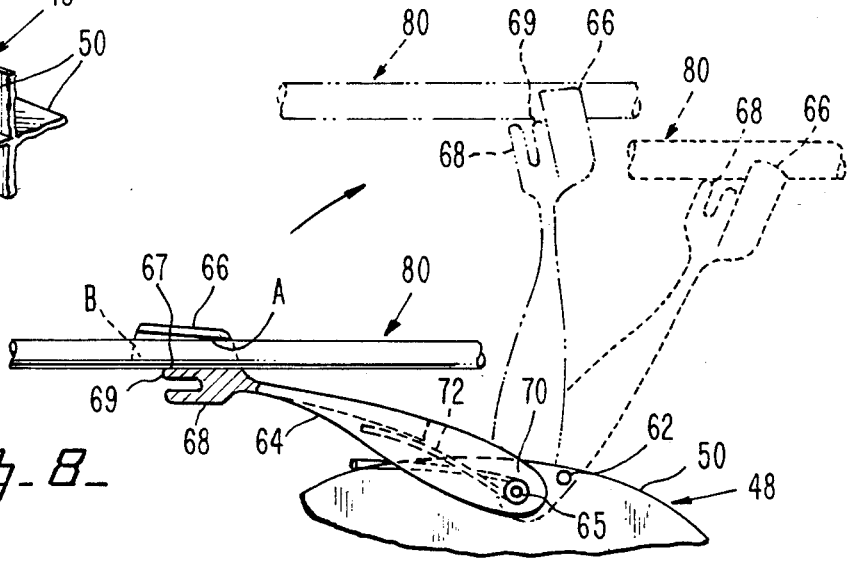
FIG. 8 is a still further enlarged side view, partly in section, illustrating one of the displacement arms and a fragmentary portion of an arrow gripped thereby, the arm being shown in full lines in its normal, retracted position, and in chain-dotted and dashed lines in successively following, displaced positions.

The construction of the arms, considered per se, is shown to best advantage in FIGS. 6–8. It is seen from these figures that each arm is of channeled formation, having at its front end a U-shaped spring clip 66 defining an arrow-receiving recess 67. Below the clip, the arms are provided with forwardly extending tongues 68.

At their proximal ends, arms 64 have extensions 70 straddling the fin 50 associated therewith, and apertured to receive pivot pin 65, whereby the arm is connected to the fin for swinging movement to the various positions shown in FIG. 8.

The rear series of arms 64 is provided with torsion springs 72 tensioned to bias the arms from their normal full line positions to their outwardly swung, arrow-displacing positions shown in FIG. 8.

The arms 64 located forwardly of the magazine 38 (FIGS. 1 and 2) have torsion springs 73, which are preferably relatively weak, to an extent that prevents them from biasing their associated arrows outwardly from the normal retracted positions shown in FIG. 2, as long as the butt ends of the arrows are engaged in retracted positions. The main purpose of the springs 73 of the front arms 64 is to retain the front arms in their outwardly swung positions after arrows have been disengaged therefrom, rather than have them swing loosely back and forth following the disengagement of the arrows.

A torsion spring 74 (FIG. 2) is anchored at one end, as at 76, to the housing 38. Spring 74 extends about the magazine, within the housing, with the other end 78 of the spring engaging the magazine. As a result, the magazine is under continuous spring bias tending to urge the same in the direction of the arrow in FIG. 3. Spring 74 is selected to assure that it will not rotate the magazine at such great speed, and with such force, as to prevent the distal end 54 of arm 52 from engaging successively following fins 50 during the normal use of the device.

Figure 4:
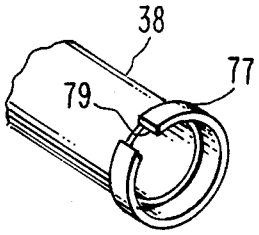
FIG. 4 is a fragmentary perspective view showing the rear end of the magazine housing.

Referring now to FIGS. 2 and 4, the rear end of the housing 38 is formed with an enlarged collar 77, in which there is formed a deep notch or recess 79. As shown in FIG. 2, the several tongues 68 of the rear series of arms 64 normally ride within and are slidably engaged with the collar 77. As a result, the collar tends to confine the arms of the rear series, preventing them from swinging outwardly to the dotted line position shown in FIG. 2 and also in FIG. 8, during the rotary movement of the magazine. Each arm remains so confined until it arrives at and is in registration with the recess 79. Recess 79 provides clearance for the tongue 68, as a result of which any arm registered with the notch 79 is freed for outward swinging movement, under the force of its associated spring 72, to the dotted line, arrow-displacing positions shown in FIGS. 2 and 8.

Conventional arrows 80 are shown, each arrow having its shaft engaged in the clips 66 of corresponding arms 64 located, respectively, forwardly and rearwardly of housing 38. The heads of the arrows, to prevent accidental injury, extend into a rearwardly opening, cup-like guard 83 rigid with the front end of magazine 48. Formed in the guard 83, at angularly spaced intervals corresponding to the angular spacing of the arrows about the housing 38, are clearance recesses 84, which permit the heads of the arrows to clear the guard when the arrows are successively displaced laterally outwardly during the normal use of the device.

The arrows are completely conventional, and at their fletched ends have nocks 86.

In use of the device, one would first load the magazine with, in the illustrated example, four arrows, each being spaced radially outwardly from an associated fin 50 as shown to best advantage in FIG. 3. Each arrow is engaged, at its tipped and butt end, by the front and rear arrow support arms 64 carried by its associated fin 50 of magazine 48.

Prior to engaging the arrows in the clips 66 of their associated arms 64, the bowman manually rotates the magazine 48 in a direction to wind the torsion spring 74, though being careful not to overload the spring, since the magazine rotates through less than 360° in displacing all the arrows carried thereby.

Initially, the starting fin 51 is engaged under the distal end 54 of the magazine release arm 42.

The bowman engages the nock of a fifth arrow in bowstring section **14*a*, supporting it as is customary on rest 88 (FIGS. 2 and 3**).

When the hunter comes within shooting range of a deer or other game animal, and discharges the already nocked arrow 80, this act will cause spring guide 31 to be snapped forwardly by the bowstring sections **14*b*, against the rear end of plunger 26. Plunger 26 is, as a consequence, snapped forwardly by guide 31, a very short linear distance amounting to perhaps nor more than $\frac{1}{8}$ or $\frac{1}{4}$ inch at the most. This is enough, however, to cause the front end of the rod to pivot arm 42, against the restraint of its spring 56, a short distance, just sufficient to cause the distal end 54 of the arm 42 to move into the recess 53 of the starting fin shown in FIGS. 3 and 9**.

As a result, under the bias of spring 74, the magazine is rotated in a counter-clockwise direction, viewing the same as in FIG. 3.

As soon as fin 51 clears the end 54 of arm 42, the arm is free to spring back to its normal position against stop 58, under the bias of spring 56. As a result, that fin 50 that immediately follows fin 51 in the sense of the direction of magazine rotation, is engaged by the end 54 of arm 42.

Engagement of this fin 50 against the magazine release arm 42 disposes the rear arrow support arm 64 of the engaged fin in registration with notch 79 on the housing collar 77. The rear arm 64 registered with notch 79 is now free to spring outwardly to the dotted line position shown in FIG. 2, under the force of its spring 72.

This drives the arrow supported by the freed arm 64 laterally outwardly, to the dotted line position shown in FIG. 2, the associated forward arm 64 swinging outwardly correspondingly to the rear arm to maintain the arrow parallel to the magazine.

At this point, it should be noted that the recesses 67 of clips 66 of the several arms 64 are, as shown in FIG. 8, angled or skewed slightly obliquely to the axes of the arrows engaged therein. The side walls of the clips 66 are springable outwardly as the shaft of the arrow enters the recess. With the front and rear arms of the associated fin 50 in their retracted positions, the arrow shaft supported therein is engaged lightly at pressure points A, B shown in FIG. 8.

When the arms are swung outwardly, this creates a cam pressure against the side walls of the clip 66, tending to force the side walls apart and free the arrows as they are laterally displaced. By skewing the recesses 67, only a very light cam pressure becomes necessary, since the lateral displacement of the arrow does not require it to exert a spreading action against the side walls of the clip over the full length of the clip all at one time. The result is that the arrow is freed from the clip very easily, when the arrow support arms swing outwardly.

Arms 64 initially swing outwardly to the chain-dotted position shown in FIG. 8, at which time the arrow is barely held in the tips of the clips 66. Further movement of the arms to the dash-line positions in FIG. 8 frees the arrow completely from the arms 64, in a position in which the arrow nock engages in the bowstring section 14*a* (FIG. 2). The bowman then draws the bowstring, without requirement of having taken his eye from the target for the purpose of selecting and nocking the fresh arrow.

With the game animal still in sight, the bowman releases the fresh arrow, and as a result, the entire operation is repeated, with the plunger 26 once again operating arm 42 to a position in which it frees the next following fin 50.

It will be seen that the discharge of an arrow triggers, by impact of the bowstring guide 31 against plunger 26, the immediate displacement of a fresh arrow to a nock position. The bowman is accordingly enabled to discharge a series of arrows in rapidly following succession, without taking his eyes from the target.

The disclosed magazine-type quiver has the desirable advantage of reducing to a minimum the interval between successively discharged arrows, without any necessity on the part of the bowman to remove his eye from the target, or for that matter, his hands from shooting position on the bow and its bowstring 14*a*. This is obviously of great importance in hunting game such as deer, because the opportunity for discharging arrows at the game after a first arrow has missed the target, must be taken advantage of with an absolute minimum loss of time. It is equally important that elimination of the requirement for re-sighting on the target be eliminated if at all possible. Both of these desirable aims are achieved by the present device.

It may be noted that it is important that the nock of the arrow be oriented so that it is in line with the string section 14*a*, when moved to the shooting position by the quiver mechanism in the manner described above. Conventionally, one feather of the arrow is of a color different from the others, and is in line with the nock. Accordingly, in loading the arrows upon the magazine, the bowman disposes this feather perpendicularly to the plane in which the associated support fin 50 lies. When, therefore, the arrow is displaced to shooting position, the nock will be in line with the bowstring section 14*a*, which itself will at this time extend substantially perpendicularly to the plane of the fin 50 from which the arrow has been displaced.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A quiver of the magazine type adapted to hold a plurality of arrows, said quiver comprising:

(a) a rotatable magazine;

(b) means for mounting said magazine upon a bow having a bowstring, said magazine being adapted to hold a plurality of arrows having retracted positions in which they are spaced from a bowstring and nock positions in which they are engaged with a bowstring ready for discharge;

(c) means for detachably loading arrows upon the magazine for movement from retracted to nock positions, said arrow-loading means comprising a plurality of arms on the magazine each of which is adapted for supporting an arrow, each of said arms having a normal position in which an arrow supported thereby is in its retracted position, each arm having a moved position in which a supported arrow is displaced to a nock position thereof; and (d) means for engaging the arms in their normal positions, and for responding to the release of a bowstring to free each arm in successively following order for movement to a moved position, for displacing a supported arrow from its retracted to its nock position.

2. A magazine-type quiver as in claim 1 wherein said means for mounting the magazine upon a bow inludes a housing in which the magazine is rotatably supported.

3. A magazine-type quiver as in claim 2 in which the arms include clips releasably engaging arrows.

4. A magazine-type quiver as in claim 3 in which supported arrows are angularly spaced about the magazine.

5. A magazine-type quiver as in claim 4, wherein the arms are pivotally mounted upon the magazine, and releasably engage arrows supported by said arms.

6. A magazine-type quiver as in claim 5 wherein the housing includes said means for engaging the arms and for freeing the same for movement to their moved, arrow-displacing positions, in successively following order.

7. A magazine-type quiver as in claim 6 in which the means for engaging the arms and for freeing the arms in successively following order is in the form of a clearance recess formed in the housing with which the arms are brought into registration in successively following order, during rotation of the magazine.

8. A magazine-type quiver as in claim 7 wherein the means responding to a bowstring releast includes a magazine release arm normally lying in a position blocking rotational movement of the magazine and adapted to be moved from said blocking position in response to release of a bowstring.

9. A magazine-type quiver as in claim 8 wherein the means responding to release of a bowstring further includes a plunger slidably mounted upon a bow to momentarily shift the magazine release arm to a position freeing the magazine for rotation.

10. A magazine-type quiver as in claim 9 wherein the means responding to release of a bowstring further includes a bowstring guide releasably engaging a bowstring, and adapted to be moved to a position in which the guide biases the plunger for actuating the magazine release arm.

11. A quiver of the magazine type adapted for supporting a plurality of arrows, said quiver comprising:

(a) a housing fixedly attachable to a bow, the housing including a lateral extension;

(b) a plate fixedly attachable to a bow, said extension being secured to the plate for rotation on an axis such that the housing is mounted for movement by a user between an operative position in which it extends generally perpendicularly to the length of a bow, and an inoperative position wherein it extends vertically in general parallelism with the length of a bow;

(c) a magazine rotatably mounted in the housing for supporting therein a plurality of arrows each having a nock, said magazine including (1) a plurality of angularly spaced fins corresponding in number to arrows supported in the magazine, and (2) arms mounted on each fin for releasably engaging an arrow, said arms having normal retracted positions in which they are engaged by the housing, and operative, freed positions in which a nock of a supported arrow is engageable with a bowstring, the arms being movable between said positions thereof;

(d) means for rotating the magazine in response to successively following releases of a bowstring in discharging arrows;

(e) means engageable with each fin in succession, on rotation of the magazine in response to said successively following releases of a bowstring; and (f) means formed in the housing for freeing the arrow support arms of each engaged fin for movement from the retracted to the operative positions thereof.

12. A quiver of the magazine type as in claim 11 wherein the magazine includes a torsion spring having ends engaged with the magazine and housing respectively, said spring biasing the magazine in a direction effective to require that the fin-engaging means engage the fins in successively following order.

13. A quiver of the magazine type as in claim 12 in which the housing has at one end thereof a collar constituting an abutment engaging the arms of all but those on the engaged fin, said collar having a clearance recess registrable with each of the several arms in succession upon rotation of the magazine to free the arrow support arms for movement from their retracted to their operative positions, when said fin-engaging means engages the fins carrying the freed arms.

14. A magazine-type quiver as in claim 13 wherein the means for engaging the fins is movably mounted upon a bow and extends from the area of a bowstring to the magazine, in position to be shifted by a released bowstring momentarily to a position freeing the fin engaged thereby, for rotation of the magazine to a position in which the next following fin will be engaged by the fin-engaging means.

15. A magazine-type quiver as in claim 14 in which the fin-engaging means includes a guide engaged by and movable in response to release of a bowstring, a plunger engageable by the guide and adapted to be shifted linearly in a forward direction, a pivoted stop arm engageable by the plunger when the plunger is shifted in said direction, and a spring tensioned to engage the stop arm with each fin of the magazine, the second-named spring yielding upon engagement of the stop arm by the plunger for movement of the stop arm by the plunger to a position freeing the engaged fin for rotation of the housing through an angular distance sufficient to bring the next following fin into engagement with the pivoted stop arm.

16. A quiver as in claim 11 including a base fixedly attachable to a bow in supporting relation to the fin-engaging means.

17. A magazine-type quiver as in claim 16 wherein the housing is elongated and includes means intermediate its ends for connecting the housing to the base, said connecting means being journalled in the base on an axis normal to the lengths of the housing and of a bow, so as to constitute means for mounting the housing on the base for bodily movement of the housing between a vertical inoperative position in which it extends generally parallel to the length of a bow, and an operative position in which it extends approximately perpendicular to said length and positions arrows generally parallel to their path of flight.

18. A magazine-type quiver as in claim 17 in which the means for connecting the housing to the base includes a lateral extension thereon having a circular neck, the base having a bearing opening in which the neck is journalled providing means for swivelly connecting the extension to said base whereby the housing is rotatably supported upon said base for movement between its inoperative and operative positions.

19. A magazine-type quiver as in claim 18 wherein the housing includes a lip and the base includes a lug engaging said lip when the housing is rotated to its operative position to provide means for limiting the housing against movement beyond said operative position.

* * * * *